US006501935B2

(12) United States Patent
Hirai et al.

(10) Patent No.: US 6,501,935 B2
(45) **Date of Patent: *Dec. 31, 2002**

(54) BELT-TYPE FIXING APPARATUS HAVING A FIXING ROLLER PROVIDED WITH A SOFT FOAM LAYER

(75) Inventors: Kazumasa Hirai, Tokyo (JP); Shigeo Kurotaka, Kanagawa (JP)

(73) Assignee: Ricoh Company, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/009,306

(22) Filed: Jan. 20, 1998

(65) Prior Publication Data

US 2002/0018676 A1 Feb. 14, 2002

(30) Foreign Application Priority Data

| | | |
|---|---|---|
| Jan. 21, 1997 | (JP) | 9-008859 |
| Mar. 7, 1997 | (JP) | 9-053020 |
| Mar. 25, 1997 | (JP) | 9-071124 |
| May 23, 1997 | (JP) | 9-133164 |

(51) Int. Cl.[7] ..... G03G 15/20
(52) U.S. Cl. ..... 399/329; 399/333
(58) Field of Search ..... 399/320, 328, 399/329, 330, 331, 333, 335

(56) References Cited

U.S. PATENT DOCUMENTS

| | | | | |
|---|---|---|---|---|
| 3,948,215 A | * | 4/1976 | Namiki | 399/328 X |
| 4,095,886 A | * | 6/1978 | Koeleman et al. | 399/328 X |
| 5,255,060 A | * | 10/1993 | Chikano | 399/331 |
| 5,465,146 A | * | 11/1995 | Higashi et al. | 399/328 |
| 5,532,808 A | * | 7/1996 | Saito et al. | 399/333 |
| 5,592,575 A | | 1/1997 | Nakazato | |
| 5,678,161 A | | 10/1997 | Kurotaka et al. | |
| 5,714,736 A | * | 2/1998 | Yoneda et al. | 399/330 |
| 5,729,812 A | * | 3/1998 | Moser | 399/329 |
| 5,752,148 A | * | 5/1998 | Yoneda et al. | 399/329 |
| 5,794,105 A | * | 8/1998 | Tamaoki et al. | 399/329 X |
| 5,873,020 A | * | 2/1999 | Matsuura et al. | 399/329 |
| 5,907,348 A | * | 5/1999 | Ogasawara et al. | |
| 5,923,930 A | | 7/1999 | Tsukamoto et al. | |
| 6,088,558 A | | 7/2000 | Yamada et al. | |
| 6,108,906 A | | 8/2000 | Fujita et al. | |
| 6,115,576 A | | 9/2000 | Nakano et al. | |
| 6,122,479 A | | 9/2000 | Fujita et al. | |
| 6,262,787 B1 | | 7/2001 | Kamoi et al. | |
| 6,295,435 B1 | | 9/2001 | Shinohara et al. | |
| 6,347,212 B1 | | 2/2002 | Kosugi et al. | |
| 6,366,751 B1 | | 4/2002 | Shakuto et al. | |

FOREIGN PATENT DOCUMENTS

| | | |
|---|---|---|
| JP | 4-322282 | 11/1992 |
| JP | 6-318001 | 11/1994 |
| JP | 8-334997 | 12/1996 |

* cited by examiner

*Primary Examiner*—Sandra Brase
(74) *Attorney, Agent, or Firm*—Oblon, Spivak, McClelland, Maier & Neustadt, P.C.

(57) ABSTRACT

A fixing apparatus which prevents a generation of wrinkles in a print paper and rapidly recovers a temperature of a fixing belt. The fixing belt is engaged with a fixing roller and a heat roller generating heat. A pressing roller is pressed against the fixing roller via the fixing belt so that a fixing process area is formed between the fixing roller and the pressing roller. The print paper is passed through the fixing process area so that a toner provided on the print paper receives a heat from the fixing belt. The fixing roller includes a foamed material layer elastically deformable by the pressing roller. A heat conductive member may be provided to transmit a heat from the heat roller to a portion of the fixing belt remote from the heat roller.

14 Claims, 12 Drawing Sheets

BELT-TYPE FIXING APPARATUS HAVING A FIXING ROLLER PROVIDED WITH A SOFT FOAM LAYER

BACKGROUND OF THE INVENTION

1. Field of the Invention

The present invention relates to a fixing apparatus used in an image forming apparatus such as a copy machine, a printer or a facsimile machine and, more particularly, to a belt-type fixing apparatus in which a heat generated by a heat roller is transferred to a nip portion between a fixing roller and a pressing roller via a fixing belt.

2. Description of the Related Art

In an image forming apparatus such as a copy machine, a printer or a facsimile machine,:a toner image is formed on a image carrier such as a photosensitive drum or an intermediate transfer belt. The toner image formed on the image carrier is transferred to a print paper or an OHP sheet by a transfer means, and the transferred toner image is fixed by a fixing apparatus. Conventionally, a heat roller fixing apparatus is used for such a fixing apparatus. In the heat roller fixing apparatus, a pressing roller is pressed against a fixing roller which is heated by a heater incorporated in the fixing roller. The pressing roller and the fixing roller are rotated in reverse directions by a drive mechanism. A print paper is conveyed through a nip portion formed between the pressing roller and the fixing roller so that a toner image on the print paper is fixed by a heat provided from the fixing roller and a pressing force applied by the pressing roller.

Japanese Laid-Open Patent Application No. 4-322282 discloses a technique for preventing generation of wrinkles in a print paper when the print paper is subjected to a fixing process in an image forming apparatus. This technique is used in a heat roller fixing apparatus comprising a pair of a fixing roller and a pressing roller. In this technique, generation of wrinkles is prevented by reducing a hardness of a conductive foam layer of the pressing roller.

In the above-mentioned heat roller fixing apparatus, there is a limit to increasing a width of the nip portion between the fixing roller and the pressing roller. In order to fix a toner image on the print paper at a low temperature, a duration (may be referred to as a nip period) of the print paper being positioned in the nip portion should be increased. That is, in order to achieve a complete fixation at a low temperature, a rotational speed of the pressing roller and the fixing roller must be reduced since the width of the nip portion cannot be increased. Thus, it is difficult to achieve a high-speed fixation.

An outer surface of the fixing roller is maintained at a high temperature due to heat provided from a heater incorporated in the fixing roller. Accordingly, a rate of increase in a temperature of the toner is high due to the increase in a nip period during which the fixing belt is located in the nip portion. This results in a decrease in a hot offset temperature which is an upper limit of a fixing temperature of the toner. The hot offset temperature is a temperature at which the hot offset phenomenon occurs. Accordingly, there is a problem in that an allowable range of a temperature for fixing the toner with a good exfoliation is decreased. The allowable range is referred to as an exfoliative fixation temperature range.

Accordingly, in order to eliminate the above-mentioned problem, Japanese Laid-Open Patent Application No.6-318001 discloses a belt-type fixing apparatus for an electrophotographic apparatus using a fixing belt. The belt-type fixing apparatus disclosed in this patent document comprises a fixing roller and a heat roller and an endless fixing belt drivingly engaged with the fixing roller and the heat roller. The fixing roller is provided with an exfoliative layer. A pressing roller is pressed against the fixing roller via the fixing belt interposed therebetween so that a nip portion is formed between the fixing belt and the pressing roller. A heating passage which extends substantially along a straight line is formed between the fixing belt and a recording medium supporting member which is provided under the fixing belt between the heat roller and the nip portion. A specific heat of the fixing belt is set to 0.002 to 0.025 cal/° C./$cm_2$.

In the above-mentioned belt-type fixing apparatus, a fixing temperature at the nip portion can be reduced due to a pre-heating effect provided to a toner image by the heating passage. Additionally, a temperature of the toner image is not excessively raised due to a self-cooling effect of the fixing belt having a small heat capacity. Thus, an exfoliation of the toner image from the fixing belt is improved, which results in. a complete fixation of the toner image without an offset even when no oil or a very small amount of oil is applied to the fixing belt.

A description will now be given, with reference to FIGS. 1 and 2, of advantages of the belt-type fixing apparatus over the heat roller fixing apparatus. FIG. 1 is an illustration showing a temperature distribution of each of a fixing roller, a toner image and a print paper. In a heat roller fixing apparatus, a fixing roller 21 comprises a metal core 21*a* and a silicon rubber layer 21*b* provided on the metal core 21*a*. On the assumption that a constant amount of heat is provided from a heater inside the metal core 21*a* in the fixing roller 21, the fixing roller is initially maintained at a constant temperature T0. A print paper 22 and a toner layer 23 forming the toner image on the print paper 22 are also maintained at a temperature Ta which is normally a room temperature (about 25° C.).

Immediately after the print paper 22 and the toner layer 23 enter the nip portion formed between the fixing roller 21 and the pressing roller 24, a temperature change from the fixing roller 21 to the print paper 22 occurs as indicated by a temperature distribution curve t1. As time passes, the distribution of temperature is changed as indicated by curves t2 and t3. At this time, an interface between the silicon rubber layer 21*b* of the fixing roller 21 and the toner layer 23 of the print paper 22 maintains a constant boundary temperature T1 (corresponding to a temperature of an upper surface of the toner layer 23).

On the other hand, as time passes, a heat is transferred from the fixing roller 21 to the toner layer 23. Thus, a boundary temperature Tf (corresponding to a temperature of a lower surface of the toner layer 23) between the toner layer 23 and the print paper 22 is increased. If the nip period is sufficiently long, the temperature distribution becomes a curve t4, and the boundary temperature T1 is increased and the boundary temperature Tf is also increased.

In the belt-type fixing apparatus, if a heat source is not provided within the nip portion, a temperature of the surface of the fixing belt is decreased as time passes since a heat is removed by the print paper through the surface of the fixing belt. This is referred to as a self-cooling effect of the fixing belt. Accordingly, the boundary temperature Tf is increased as time passes. However, as long as the boundary temperature T1 is concerned, the boundary temperature T1 does not sharply increase as is in the conventional heat roller fixing apparatus.

A hot offset phenomenon occurs at the interface between the fixing roller 21 and the toner layer 23 when an interface adhesive force of the toner layer 23 exceeds a cohesive force related to a viscoelasticity when the toner is melted. That is, the hot offset phenomenon is influenced by the level of the boundary temperature T1 which is a temperature of the interface between the silicon rubber layer 21*b* of the fixing roller 21 and the toner layer 23. Additionally, a fixation can be achieved when the interface adhesive force exceeds the cohesive force of the toner which is related to the viscoelasticity of the toner when the toner is melted. That is, the fixation is influenced by the level of the boundary temperature Tf which is a temperature of the interface between the toner layer 23 and the print paper 22.

FIG. 2 is a graph showing fixation temperature characteristics of the heat roller fixing apparatus and the belt-type fixing apparatus. In FIG. 2, the horizontal axis represents a nip period which is a period during which the fixing belt is located in the nip portion, and the vertical axis represents a fixing temperature. A surface temperature of the fixing roller of the heat roller fixing apparatus is indicated by a fine solid line, and a surface temperature of the fixing roller of the belt-type fixing apparatus is indicated by a bold solid line. Additionally, a temperature of the toner of the heat roller fixing apparatus is indicated by a fine dashed line, and a temperature of the toner of the belt-type fixing apparatus is indicated by a bold dashed line.

As interpreted from FIG. 2, in a range (fixable range) of the temperature in which the. toner is fixable, the temperature in the heat roller fixing apparatus rapidly increases as the nip period is increased, whereas an increase in the boundary temperature T1 can be prevented in the belt-type fixing apparatus due to the self-cooling effect of the fixing belt which results in a gentle increase of the temperature of the toner. Accordingly, when the nip time can be increased, the belt-type fixing apparatus has a greater allowance than the heat roller fixing apparatus with respect to the offset of the toner.

In the above-mentioned conventional belt-type fixing apparatus, since the pre-heating process of the toner is performed by heating an atmosphere of the toner, there is a problem that a sufficient pre-heating cannot be achieved when the pre-heating process must be performed at a high speed. Additionally, since the fixing roller is made of a solid rubber, a stress due to a thickness of the print paper cannot be absorbed which results in an uneven distribution of a pressure in which the pressure at an entrance of the nip portion is low and a pressure in the middle of the nip portion is high. Accordingly, there is a problem in that wrinkles are generated in the print paper because the print paper, which has been heated in the pre-heating process resulting in a generation of a partial unflatness due to evaporation of water contained in the print paper, is pressed by a large surface pressure in the nip portion having an uneven pressure distribution.

Additionally, in the above-mentioned belt-type fixing apparatus, there is a problem in that a recovery of a temperature of the surface of the fixing belt to a predetermined fixing temperature takes a long time since a heat roller is the only means for heating the fixing belt and the temperature of the surface of the fixing belt is considerably decreased when the fixing belt passes through the nip portion.

SUMMARY OF THE INVENTION

It is a general object of the present invention to provide an improved and useful fixing apparatus in which the above-mentioned problems are eliminated.

A more specific object of the present invention is to provide a fixing apparatus in which a generation of wrinkles in a print paper can be prevented when the print paper is passed through a nip portion between a fixing belt and a pressing roller.

Another object of the present invention is to provide a fixing apparatus in which a print paper is positively separated from the fixing belt after the print paper and the fixing belt exit the nip portion.

A further object of the present invention is to provide a fixing apparatus in which a temperature of the fixing belt can be rapidly recovered after the fixing belt passes through the nip portion and the temperature of the fixing belt is decreased.

In order to achieve the above-mentioned objects, there is provided according to one aspect of the present invention a fixing apparatus for fixing a toner provided on a recording sheet, the fixing apparatus comprising:

a fixing roller;

a heat roller generating heat;

an endless fixing belt drivingly engaged with the fixing roller and the heat roller; and a pressing roller pressed against the fixing roller via the fixing belt so that a fixing process area is formed between the fixing roller and the pressing roller, the recording sheet being passed through the fixing process area so that the toner provided on the recording sheet receives a heat from the fixing belt, wherein the fixing roller includes a foamed material layer elastically deformable by the pressing roller.

According to the above-mentioned invention, the fixing roller has a foamed material layer which elastically deforms when the pressing roller is pressed against the fixing roller. The foamed material has a relatively low hardness as compared to a solid rubber material. Thus, a surface pressure in the fixing process area (nip portion) between the fixing roller and the pressing roller is substantially uniform and low over an entire length of the fixing process area. Thus, a generation of wrinkles in the recording sheet can be prevented when the recording sheet entering the fixing process area has a waving part. Additionally, the foamed material layer of the fixing roller serves as a heat insulating material to prevent a release of heat from the fixing process area. Thus, a sufficient amount of heat can be provided to the toner on the recording sheet while the recording sheet passes through the fixing process area.

In one embodiment of the fixing apparatus according to the present invention, the foamed material layer of the fixing roller may have a hardness ranging from 10° to 50° measured by Asker C. Additionally, the foamed material layer may be made of a foamed silicon rubber. The pressing roller may also include a foamed material layer which is preferably made of a foamed silicon rubber.

Additionally, a hardness of the foamed material layer of the fixing roller may be lower than a hardness of the pressing roller. When the hardness of the fixing roller is lower than the hardness of the pressing roller, the fixing roller is elastically deformed by the pressing roller so that the deformed portion of the fixing roller in the fixing process area substantially follows a shape of the pressing roller. Thus, the recording sheet exiting from the fixing process area is moved in a direction in which the recording sheet is positively separated from the fixing belt which follows an outer surface of the fixing roller. Thus, an undesired adherence of the recording sheet to the fixing belt, which results in an occurrence of an excessive melt and a hot offset of the toner, can be prevented.

In one embodiment of the fixing apparatus according to the present invention, the pressing roller may pressingly contact the fixing belt before the fixing process area is formed so that a pre-heating area is formed as a contact area of the pressing roller and the fixing belt.

Additionally, there is provided according to another aspect of the present invention a fixing apparatus for fixing a toner provided on a recording sheet, the fixing apparatus comprising:

a fixing roller;

a heat roller generating heat;

an endless fixing belt drivingly engaged with the fixing roller and the heat roller;

a pressing roller pressed against the fixing roller via the fixing belt so that a fixing process area is formed between the fixing roller and the pressing roller, the recording sheet being passed through the fixing process area so that the toner provided on the recording sheet receives a heat from the fixing belt; and a heat conductive member having a first end surface and a second end surface remote from the first end surface, the first end surface contacting the heat roller, the second end surface contacting the fixing belt.

According to the above-mentioned invention, heat generated by the heat roller can be transmitted to a position remote from the heat roller through the heat conductive member. Thus, if the second end surface of the heat conductive layer is. in contact with a portion of fixing belt having a decreased temperature, a recovery time of temperature of the fixing belt can be reduced.

In one embodiment of the present invention, the heat conductive member may be positioned inside of a loop formed by the fixing belt, and the second end surface of the heat conductive member contacts an inner surface of the fixing belt.

Additionally, the heat conductive member is made of an elastically deformable material so that the second end surface of the heat conductive member always contacts the fixing belt even when a slack is generated in the fixing belt.

In one embodiment of the present invention, a width of a contact area of the heat conductive member to the fixing belt is variable in response to a width of the recording sheet, the width being measured in a direction perpendicular to a moving direction of the fixing belt. Accordingly, a non-contact portion of the fixing belt which does not contact the recording sheet can be prevented from being heated by the heat conductive member. Thus, an excessive heating of the non-contact portion can be prevented.

Additionally, the fixing apparatus according to the present invention may further comprise a heat insulating material covering surfaces of the heat conductive material other than the first end surface and the second end surface.

In this invention, the heat insulating material prevents a release of heat from the heat conductive member. Thus, the heat is efficiently transmitted from the heat roller to the fixing belt. Additionally, since a heat is not released from the heat conductive member which may positioned adjacent to a portion of the fixing belt which has been heated at an appropriate temperature, an influence of a heat released from the heat conductive member can be eliminated.

Other objects, features and advantages of the present invention will become more apparent from the following detailed description when read in conjunction with the accompanying drawings.

DETAILED DESCRIPTION OF THE PREFERRED EMBODIMENTS

Figure 1:
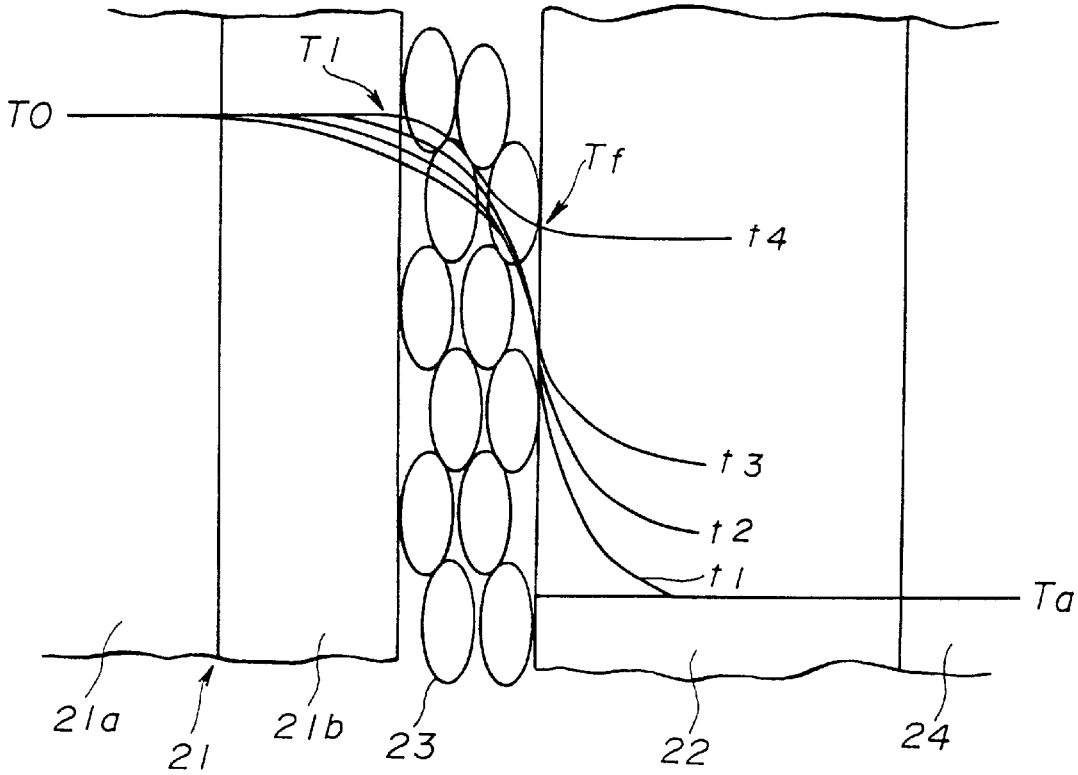
FIG. 1 PRIOR ART
FIG. 1 is an illustration showing a temperature distribution of each of a fixing roller, a toner image and a print paper.
Figure 2:
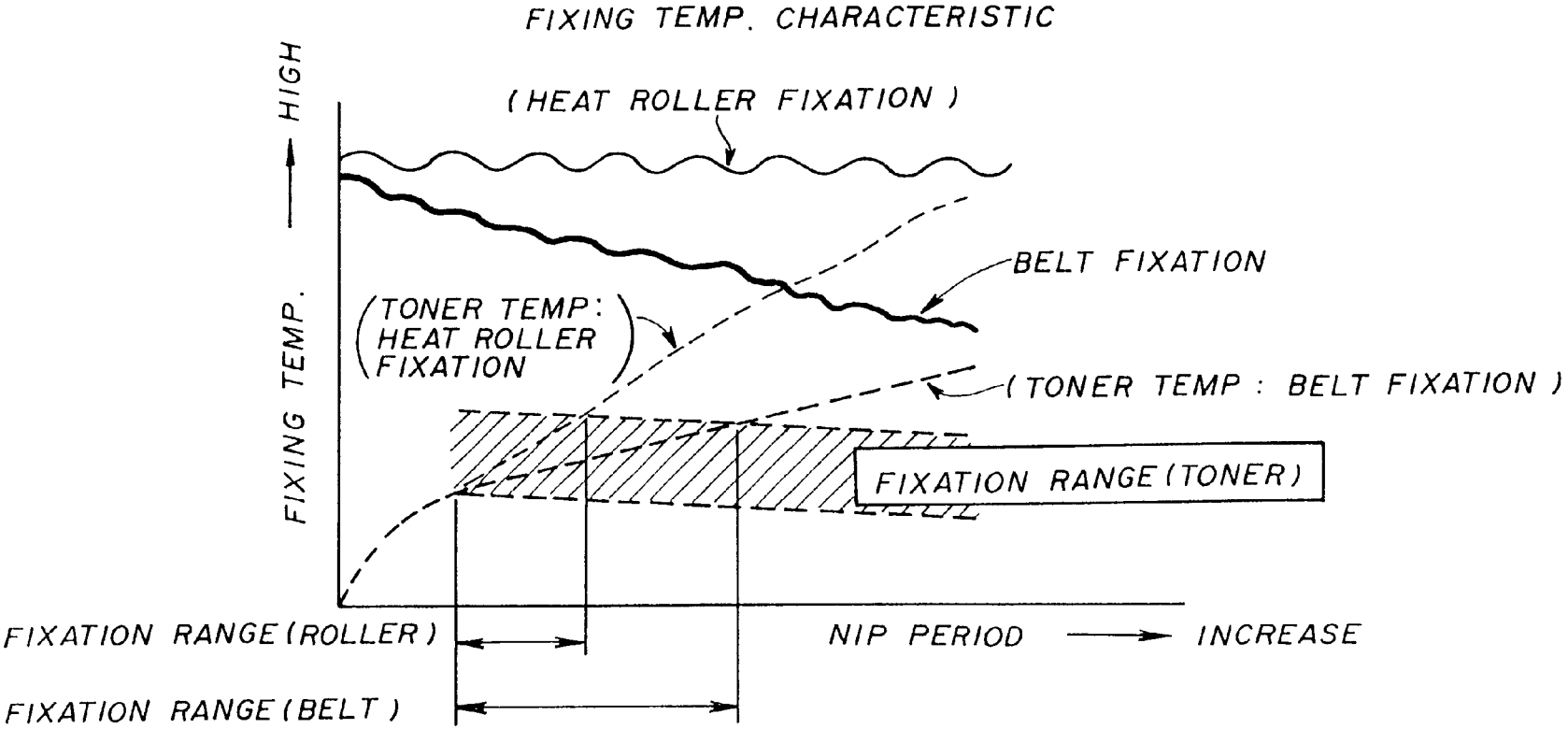
FIG. 2 PRIOR ART
FIG. 2 is a graph showing fixation temperature characteristics of a heat roller fixing apparatus and a belt-type fixing apparatus.

A description will now be given of a mode for carrying out the invention corresponding to first, second and third embodiments of the present invention.

A fixing apparatus according to the present invention comprises a fixing roller, a heat roller and an endless fixing belt drivingly engaged with the heat roller and the fixing roller. A pressing roller is pressed against the fixing roller. The heat roller is provided with a heater. A heater may also be provided in the pressing roller. A first nip portion (pre-heating area) is formed by the pressing roller and a portion of the fixing belt which is not in contact with the fixing roller. That is, in the first nip portion, the pressing roller is pressed against the portion of the fixing belt but the portion of the fixing belt is not in contact with the fixing roller. A second nip portion (fixing process area) is formed by the fixing roller and the pressing roller being pressed against the fixing roller via the fixing belt.

In order to prevent a print paper (a recording sheet) from being wrinkled, the fixing roller is composed of a metal core and a heat-resistive elastic layer provided on the metal core. The heat-resistive elastic layer includes a foamed material layer having a hardness ranging from 10° to 50° measured by Asker C (Asker C 300 g load (hereinafter simply referred to as Asker C)). A silicon sponge rubber (foamed silicon rubber) is preferably used as the heat-resistive elastic layer having such a foamed material layer. If the hardness of the heat-resistive elastic layer is less than 10°, a pressure in the second nip portion may be insufficient. This may result in problems of an incomplete fixation of the toner and a decrease in an exfoliative temperature range due to an increase in the lower limit of the fixing temperature. On the other hand, if the hardness of the heat-resistive elastic layer exceeds 50° by Asker C, wrinkles are generated in the print paper. Accordingly, in order to prevent a generation of wrinkles, the hardness of the fixing roller is preferably 10° to 50° measured by Asker C. Additionally, the upper limit of the hardness of the foamed material used for the heat-resistive elastic layer is 60° measured by Asker C. If the hardness exceeds 60°, a foaming ratio is reduced, and a heat insulation effect and a wrinkle reduction effect of the foamed material are reduced. Accordingly, the heat-resistive elastic layer can be made of any elastic material which has a hardness falling in the above-mentioned range. For example, the heat-resistive elastic layer may be formed by a structure disclosed in Japanese Laid-Open Patent Application No.4-322282 which structure comprises a foamed material layer and a cavity provided in the foamed material layer, the cavity being larger than a bubble of the foamed material layer.

The heat roller can be any structure as long as it incorporates a heater for heating the fixing belt so as to provided an appropriate amount of heat to the fixing belt. However, in order to reduce a warm-up time of the apparatus, the heat roller may preferably comprise a thin metal pipe so as to reduce a heat mass.

It should be noted that the heater for heating the fixing belt is not limited to the heater which is incorporated in the heat roller, and may be provided inside the pressing roller depending on the application.

The fixing belt is constructed to have a small heat mass so that a self-cooling effect can be provided, and is provided with a exfoliative layer on an outer surface thereof.

The pressing roller comprises a metal core and a heat-resistive elastic material layer provided on the metal core. In order to provide a sufficient amount of heat to the toner, the heat-resistive elastic material layer preferably includes a foamed material layer such as a silicon sponge rubber (foamed silicon rubber) which may provide a heat insulation effect. Additionally, in order to prevent adherence of a print paper to the fixing belt after the print paper exits a nip portion, a hardness of the pressing roller is preferably higher than a hardness of the fixing roller. In other words, the hardness of the fixing roller is preferably lower than the hardness of the pressing roller. Particularly, in order to positively prevent the adherence of the print paper to the fixing belt, a difference in the hardness of the pressing roller and the fixing roller may preferably be 0° to 30° measured by Asker C.

Since the hardness of the fixing roller is preferably 10° to 50° measured by Asker C as mentioned above, the hardness of the pressing roller is preferably 10° to 50° so as to achieve the hardness of the pressing roller being greater than the hardness of the fixing roller.

In the belt-type fixing apparatus according to the present invention, in order to sufficiently pre-heat a toner by a high-speed operation, a first fixing process section (pre-heating area) is formed by the pressing roller pressing the fixing belt without pressing the fixing roller. A second fixing process section (fixing process area) is formed by the pressing roller pressing the fixing roller via the fixing belt. Thus, the fixing roller, the heat roller, the fixing belt and the pressing roller are configured and arranged so that the first and second fixing process sections are appropriately formed.

Figure 3:
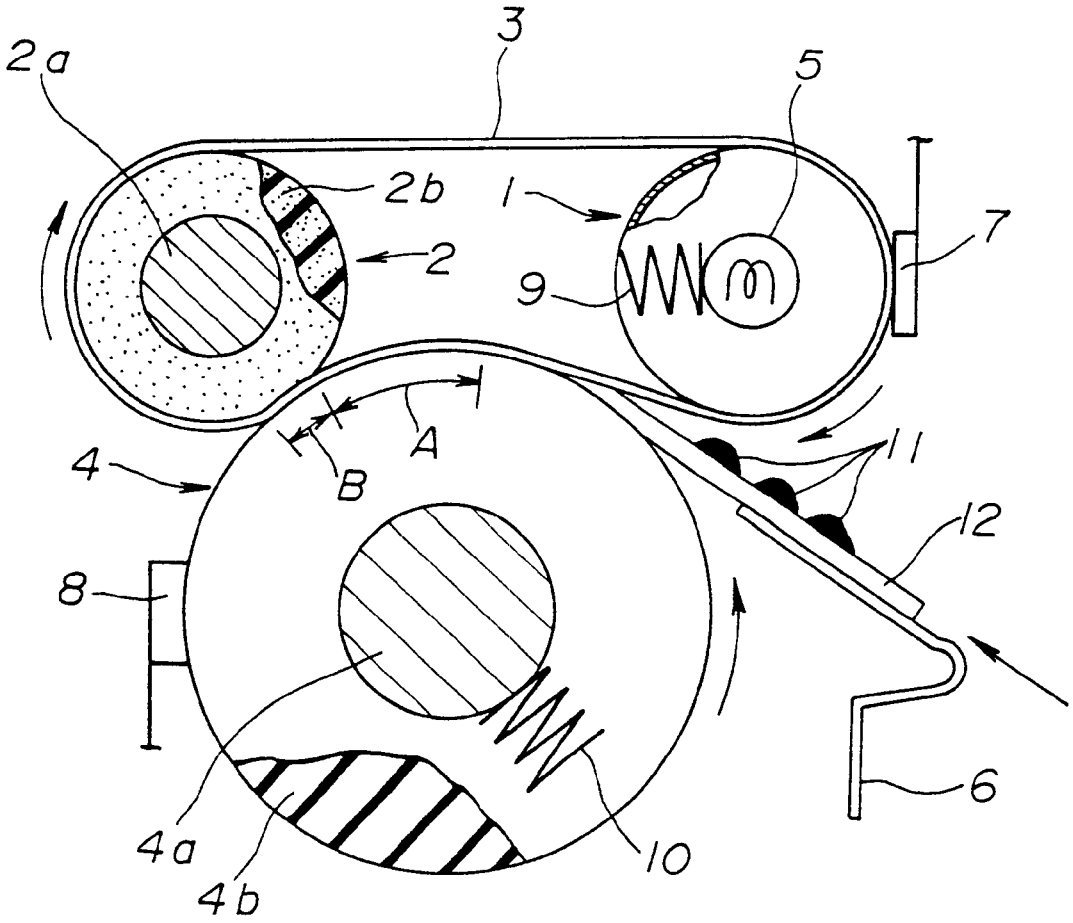
FIG. 3 is an illustration of a part of a fixing apparatus according to a first embodiment of the present invention.

A description will now be given of a first embodiment of the present invention. FIG. 3 is an illustration of a part of a fixing apparatus according to the first embodiment of the present invention.

The fixing apparatus according to the first embodiment of the present invention comprises a heat roller 1, a fixing roller 2, a fixing belt 3, a pressing roller 4, a halogen heater 5 for heating the fixing belt 3, a guide plate 6, thermistors 7 and 8 and pressing springs 9 and 10.

The heat roller 1 comprises a thin wall metal pipe having a small diameter so as to reduce a heat mass in order to reduce a warm-up time of the fixing apparatus. As for the metal pipe, an aluminum pipe or a steel pipe may be used. In this embodiment, an aluminum pipe having a diameter of 30 mm and a thickness of 3 mm is used.

The fixing roller 2 comprises a metal core 2*a* having a diameter of 32 mm and a heat-resistive elastic material layer 2*b* provided on the metal core 2*a*. The heat-resistive elastic material layer 2*b* has a thickness of 4 mm. An outer diameter of the fixing roller 2 is 40 mm. The metal core 2*a* is made of aluminum. The heat-resistive elastic material layer 2*b* comprises a silicon sponge rubber, and has a hardness of 30° measured by Asker C. The fixing belt 3 comprises a nickel electroformed sheet provided with a silicon rubber layer. In this embodiment, the nickel electroformed sheet has a thickness of 40 $\mu$m, and the silicon rubber layer has a thickness of 150 $\mu$m.

The pressing roller 4 comprises a metal core 4*a* and a heat-resistive elastic material layer 4*b* provided on the metal core 4*a*. In this embodiment, the metal core 4*a* has a diameter of 48 mm, and the heat-resistive elastic material layer 4*b* has a thickness of 1 mm. Thus, an outer diameter of the pressing roller 4 is 50 mm. The metal core is made of aluminum. The heat-resisitive elastic material layer 4*b* is made of a silicon solid rubber having a hardness of 42° measured by Asker C.

The halogen heater 5 comprises a halogen lamp provided inside the heat roller 1. The guide plate 6 is located on the upstream side of a portion in which the pressing roller 4 contacts the fixing belt 3 in a conveying direction of a print paper (recording sheet) 12. The guide plate 6 is provided for guiding the print paper to the portion between the pressing. roller 4 and the fixing belt 3.

The thermistor 7 detects a temperature of a surface of the fixing belt 3 which is heated by the heat roller 1. The thermistor 8 detects a temperature of a surface of the pressing roller 4. In the fixing apparatus according to the present embodiment, the halogen heater 5 is feedback controlled by a control means (not shown in the figure) based on the temperatures detected by the thermistors 7 and 8 so that the temperature of the surface of the fixing belt 3 and the temperature of the surface of the pressing roller 4 are maintained to be substantially constant.

The pressing spring 9 is provided for pressing the heat roller 1 so as to provide a tension to the fixing belt 3. The pressing spring 10 presses the pressing roller 4 so that the pressing roller 4 is pressed against the fixing roller 2 via the fixing belt 3. It should be noted that a separating claw (not shown in the figure) is provided on the downstream side of a second nip portion B so as to separate the print paper 12, which has passed through the second nip portion B, from the pressing roller 4.

The print paper 12 guided by the guide plate 6 is provided with a toner 11 of a polyester type. The print paper 12 is a regular paper having a thickness of 100 $\mu$m.

The pressing roller 4 contacts and presses the fixing belt 3 without pressing the fixing roller 2 so that a first nip portion A is formed which corresponds to the first fixing process section. The pressing roller 4 presses the fixing roller 2 via the fixing belt 3 so that the second nip portion B is formed which corresponds to the second fixing process section B. A length of each of the first nip portion A and the second nip portion B is set to about 10 mm. A surface pressure in the second nip portion B is set to about 1.5 $Kg/cm_2$.

In the above-mentioned fixing apparatus, the print paper 12 having a layer of toner 11 (toner image) is conveyed to a fixing section by being guided by the guide plate 6. The toner image is formed on the print paper 12 by an electrophotographic type image forming apparatus. The fixing belt 3 is heated by the heat roller 1 so that a temperature of a surface of the fixing belt 3 contacted by the thermistor 7 is set to about 140° C. A surface of the pressing roller 4 is raised to about 110° C. since the pressing roller 4 rotatably contacts the fixing belt 3. The heat roller 1, the fixing belt 3, the fixing roller 2 and the pressing roller 4 are rotated in directions indicated by arrows, respectively, in the figure.

When the print paper 12 passes the first nip portion A, the toner 11 gradually melts due to a heat from the fixing belt 3 and is tentatively fixed onto the surface of the print paper 12. Since the fixing belt 3 is separated from the heat roller 1 as the fixing belt 3 moves, a temperature of the fixing belt 3 decreases due to a self-cooling action by release of heat. In the second nip portion B, the toner 11 is completely fixed onto the print paper 12, and the print paper 12 is separated from the fixing belt 3 at the exit. At this time, the temperature of the surface of the fixing belt 3 is reduced to less than 120° C. Thus, an increase in the temperature of an interface between the toner 11 and the fixing belt 3 is less than that of the heat roller fixing apparatus, and a hot offset of the toner 11 to the fixing belt 3 is prevented.

In the above-mentioned fixing apparatus, the print paper 12 is heated by the fixing belt 3 and the pressing roller 4 when the print paper 12 passes through the first nip portion A. Accordingly, water contained in the print paper 12 evaporates by the heat provided by the fixing belt 3 and the pressing roller 4. This results in the print paper 12 is partially waved. If the fixing roller 2 is made of a solid rubber having a relatively high hardness, the width of the nip portion B cannot be set to about 10 mm. Then, when the print paper 12 enters the second nip portion B and if the fixing roller 2 is made of a solid rubber having a relatively high hardness, the waving of the print paper 12 generated in the first nip portion A is pressed by a large pressing force, resulting in generation of wrinkles in the print paper 12.

Figure 4A:
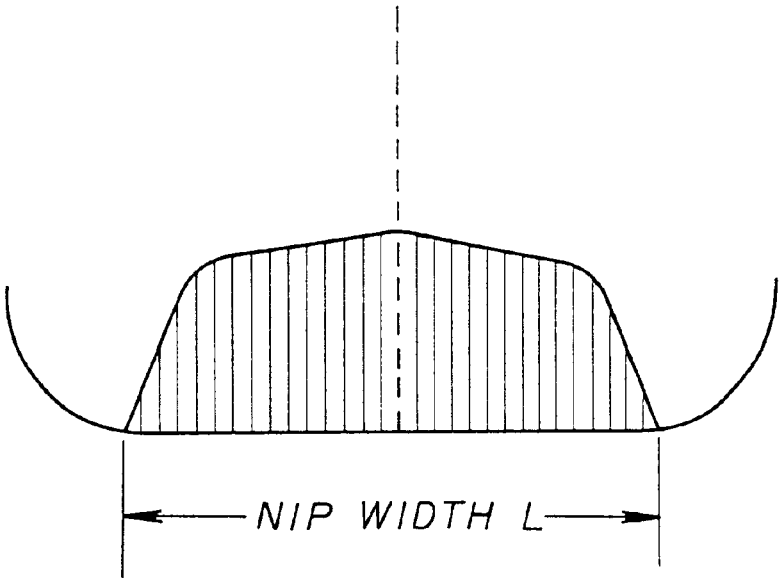
FIG. 4A is an illustration showing a pressure distribution in a second nip portion when a fixing roller is made of a sponge material.
Figure 4B:
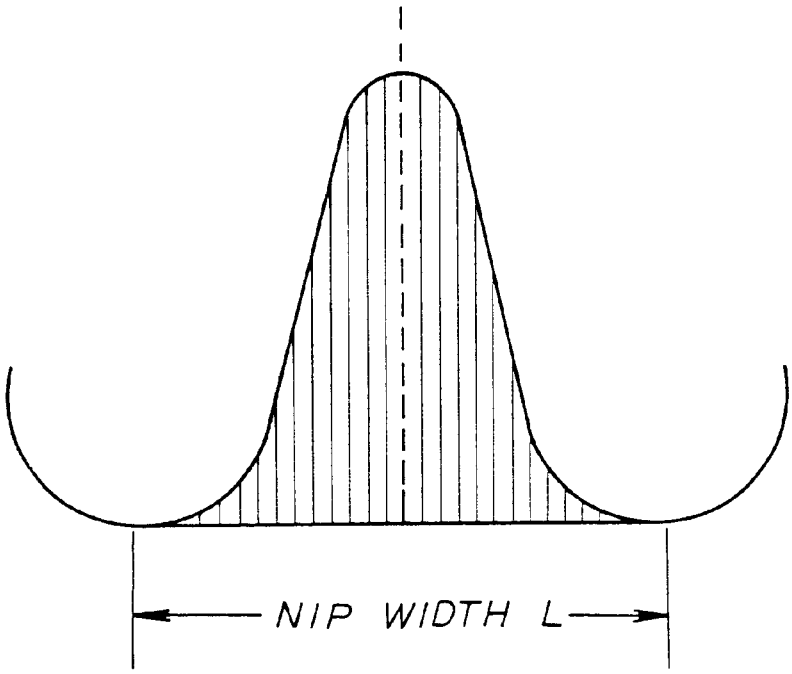
FIG. 4B is an illustration showing a pressure distribution in the second nip portion when the fixing roller is made of a solid rubber.

A further description will now be given, with reference to FIGS. 4A and 4B, of a difference between a case in which the fixing roller 2 is made of a solid rubber and a case in which the fixing roller 2 is made of a sponge material. FIG. 4A shows a pressure distribution in the second nip portion B when the fixing roller 2 is made of a sponge material; FIG. 4B shows a pressure distribution in the second nip portion B when the fixing roller 2 is made of a solid rubber.

When the fixing roller 2 is made of a sponge roller, the pressure distribution becomes substantially flat and low over an entire width of the second nip portion B as shown in FIG. 4A. On the other hand, when the fixing roller 2 is made of a solid rubber, a pressure in the middle of the second nip portion B becomes considerably high as shown in FIG. 4B when a width of the second nip portion B is the same as that of the second nip portion B formed by the fixing roller 2 made of a sponge material. Since more wrinkles are generated as a higher pressure is applied to the print paper 12, more wrinkles are generated when the fixing roller 2 is made of a solid rubber. It was observed that wrinkles were generated when the fixing roller 2 was made of a solid rubber having a hardness of 30° measured by Asker C whereas no wrinkle was generated when the fixing roller 2 was made of a sponge material having a hardness of 50° measured by Asker C.

In the first embodiment, since the fixing roller 2 is made of a silicon rubber sponge (foamed silicon rubber), a stress in the print paper 12 is absorbed by the softness of the fixing roller 2. Thus, the fixing roller 2 of the present embodiment does not press a wave generated in the print paper 12, resulting in prevention of generation of wrinkles when the print paper 12 passes through the second nip portion B.

Experiments were performed by varying the hardness of the fixing roller 2 so as to investigate a relationship between the hardness of the fixing roller 2 and the generation of wrinkles in the print paper 12. A result of the experiments is shown in Table 1. Conditions of the experiments were as follows.

a) temperature of the fixing belt 3 heated by the heat roller 1 . . . 140 [° C.]
b) temperature of the pressing roller 4 . . . 100 [° C.]
c) line velocity of the fixing belt 3 . . . 100 [mm/sec]
d) width of the first nip portion A . . . 10 [mm]
e) width of the second nip portion B . . . 10 [mm]
f) print paper 12 . . . regular paper (RICOH TYPE 6000) having a thickness of 0.1 [mm]
g) fixing roller 2 . . . foamed material

TABLE 1

| hardness of fixing roller (Asker C) | generation of wrinkles |
|---|---|
| 10° | no |
| 20° | no |
| 30° | no |
| 35° | no |
| 40° | no |
| 45° | no |
| 50° | no |
| 55° | yes |

As can be appreciated from the result of the experiments, wrinkles were not generated in the print paper 12 when the hardness of the fixing roller 2 was within a range from 10° to 50° measured by Asker C.

In the above-mentioned first embodiment, since the fixing roller 2 is made of a foamed material or sponge material having a low hardness (from 10° to 50° measured by Asker C), a surface pressure in the second nip portion B can be maintained at a low level. Thus, a stress generated in the print paper 12 is absorbed so as to prevent a generation of wrinkles in the print paper 12.

Additionally, since the fixing roller 2 is made of a foamed material, a decrease in the temperature of the fixing belt 3 can be minimized. This is because the foamed material serves as a heat insulating material which prevents absorption of heat from the fixing belt 3 when the fixing belt 3 contacts the fixing roller 2.

Figure 5:
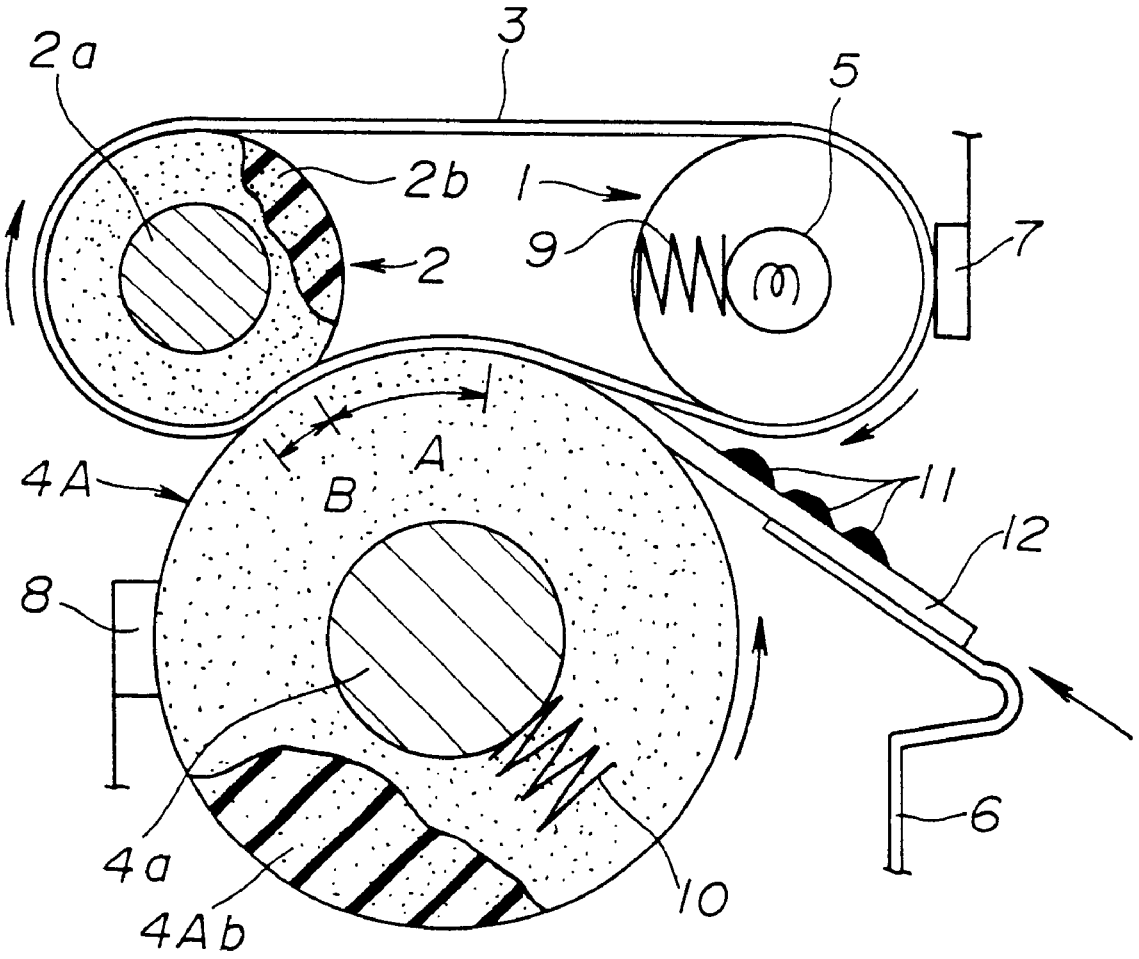
FIG. 5 is an illustration of a part of a fixing apparatus according to a second embodiment of the present invention.

A description will now be given, with reference to FIG. 5, of a second embodiment of the present invention. FIG. 5 is an illustration of a part of a fixing apparatus according to the second embodiment of the present invention.

The fixing apparatus according to the second embodiment of the present invention has the same structure as that of the first embodiment except for the pressing roller 4 being replaced with a pressing roller 4A. The pressing roller 4A has a heat-resistive elastic material layer 4Ab instead of the heat-resistive elastic material layer 4*b* of the pressing roller 4. The heat-resistive elastic material layer 4Ab is made of silicon sponge rubber.

A thermal conductance of a silicon rubber is about 0.19 W/m·K, and a thermal conductance of air is about 0.034 W/m·K. Thus, the thermal conductivity of air is lower than the thermal conductivity of a silicon rubber. Accordingly, the silicon sponge rubber absorbs less heat than a solid silicon rubber since the silicon sponge rubber is a foamed material which contains a large amount of air.

When the print paper 12 which has been pre-heated in the first nip portion A enters the second nip portion B, a heat provided by the fixing belt 3 is hardly transmitted to the pressing roller 4A and the fixing roller 2 via the print paper 12 since the heat conductivity of each of the pressing roller 4A and the fixing roller 2 is low. That is, the foamed material layer of each of the pressing roller 4A and the fixing roller 2 serves as a heat insulating layer. Thus, the temperature of the print paper 12 is maintained, and the toner 11 on the print paper 12 is efficiently and sufficiently melted by a heat received from the fixing belt 3.

As mentioned above, in the fixing apparatus according to the second embodiment, since each of the pressing roller 4A and the fixing roller 2 has the foamed layer which serves as a heat insulating layer, heat in the second fixing process section (second nip portion B) is hardly released outside the second fixing process section. Thus, a sufficient amount of heat can be provided to the toner 11 in the second fixing process section.

A description will now be given of a third embodiment of the present invention. A fixing apparatus according to the third embodiment of the present invention has the same structure as that of the fixing apparatus according to the second embodiment of the present invention except that the hardness of the fixing roller is varied. Specifically, the fixing roller 2 of the third embodiment has a hardness smaller than a hardness of the pressing roller 4A.

Figure 6A:
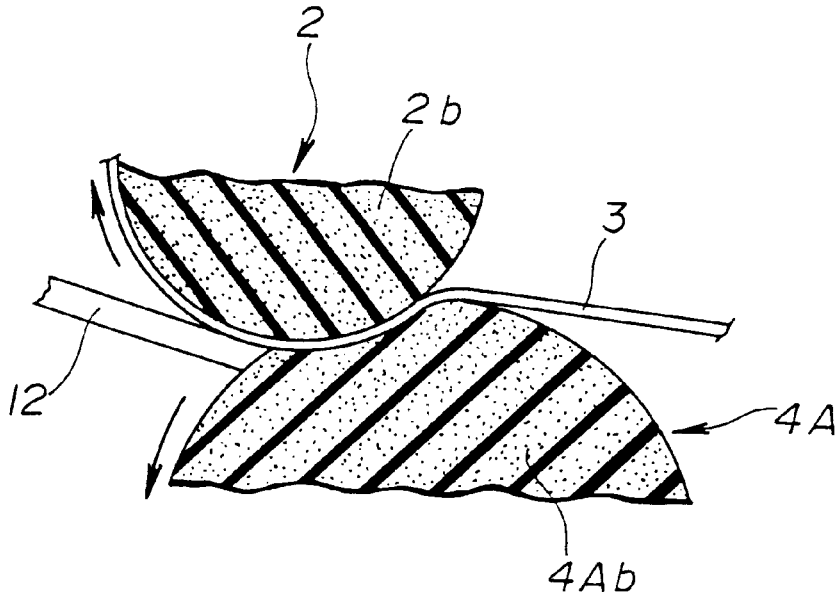
FIG. 6A is an illustration of a second nip portion formed between a fixing roller and a pressing roller when a hardness of the fixing roller is higher than a hardness of the pressing roller.
Figure 6B:
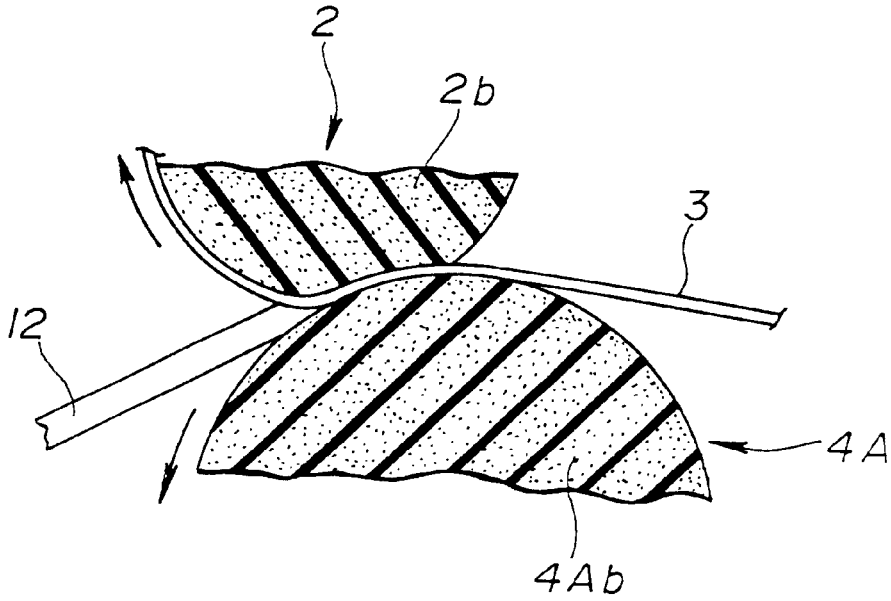
FIG. 6B is an illustration of a second nip portion formed between the fixing roller and the pressing roller when the hardness of the fixing roller is less than the hardness of the pressing roller.

FIG. 6A is an illustration of the second nip portion B formed between the fixing roller 2 and the pressing roller 4 when the hardness of the fixing roller 2 is higher than the hardness of the pressing roller 4A; FIG. 6B is an illustration of the second nip portion B formed between the fixing roller 2 and the pressing roller 4A when the hardness of the fixing roller 2 is less than the hardness of the pressing roller 4A.

When the hardness of the fixing roller 2 is greater than the hardness of the pressing roller 4A, the pressing roller 4A is deformed as shown in FIG. 6A as pressing roller 4A is pressed against the fixing roller 2 in the second nip portion B. Accordingly, the print paper 12 conveyed by the fixing belt 3 is ejected from the second nip portion B so that the print paper 12 moves in a direction toward the fixing belt 3 after the print paper 12 exits the second nip portion B. In this case, the print paper 12 may wind itself on the fixing belt 3. Thus, there is a problem in that an excessive melt and a hot offset of the toner 11 may occur due to an increase in a nip period caused by the winding of the print paper 12 on the fixing belt 3.

On the other hand, in the present embodiment, since the hardness of the fixing roller 2 is set to 26° measured by Asker C and the hardness of the pressing roller 4A is set to 30° measured by Asker C, the fixing roller 2 is deformed due to the pressing force applied by the pressing roller 4A in the second nip portion B as shown in FIG. 6B. Thus, after the print paper 12 exits the second nip portion B, the print paper 12 moves in a direction away from the fixing belt 3. Thus, the excessive melt and the hot offset of the toner 11 due to the increase in the nip period caused by the winding of the print paper 12 on the fixing belt 3 can be prevented.

Figure 7:
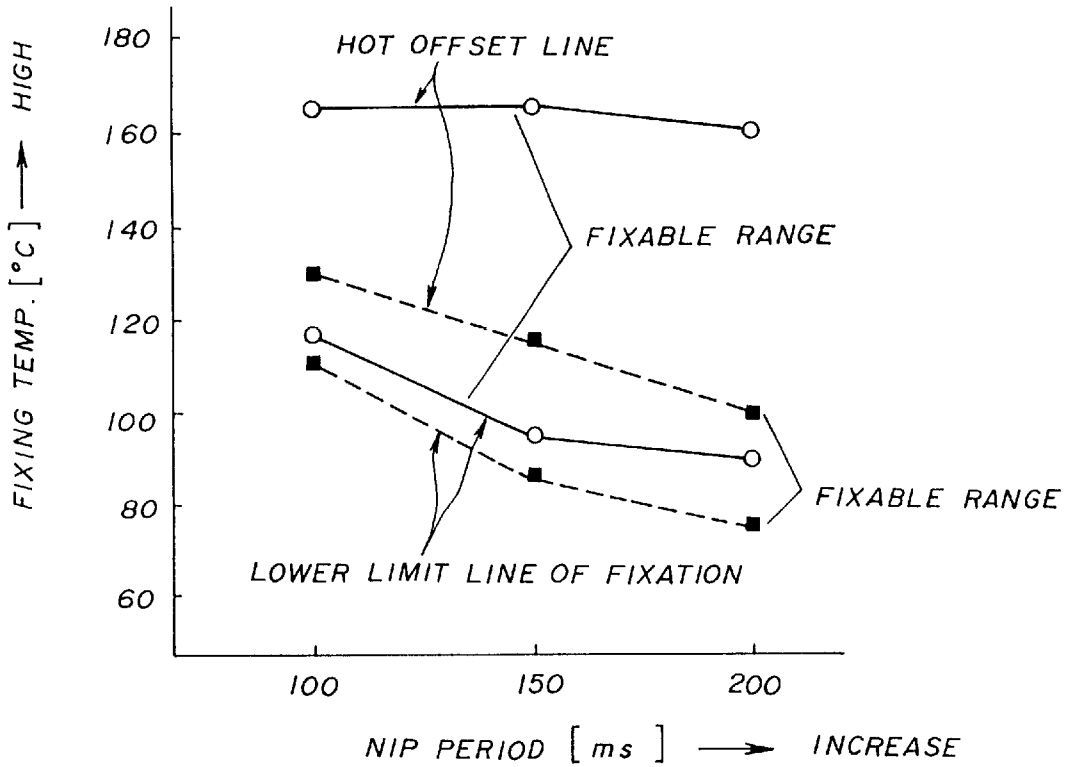
FIG. 7 is a graph showing a result of experiments using the fixing apparatuses according to the first to third embodiments of the present invention.

FIG. 7 is a graph showing a result of experiments using the fixing apparatuses according to the above-mentioned first to third embodiments of the present invention. In the graph shown in FIG. 7, the horizontal axis represents a nip period, and the vertical axis represents a fixing temperature. It is appreciated from the graph of FIG. 7, the fixing apparatuses according to the first to third embodiments of the present invention have a fixable temperature range greater than that of the conventional fixing apparatus. That is, the fixing apparatuses according to the first to third embodiments of the present invention have an allowance greater than that of the conventional fixing apparatus with respect to the fixing temperature range.

As mentioned above, in the third embodiment of the present invention, since the hardness of the fixing roller 2 is smaller than the hardness of the pressing roller 4A, the fixing roller 2 is deformed to follow the shape of the pressing roller 4A in the second fixing process section (second nip portion B). Accordingly, an angle formed between a direction of the print paper 12 and the direction of the fixing belt 3 is increased, which prevents the winding of the print paper 12 on the fixing belt 3. Additionally, the excessive melt of the toner 11 due to the winding of the print paper 12 can be prevented. Further, a range of fixable temperature can be increased with a stability.

Figure 8:
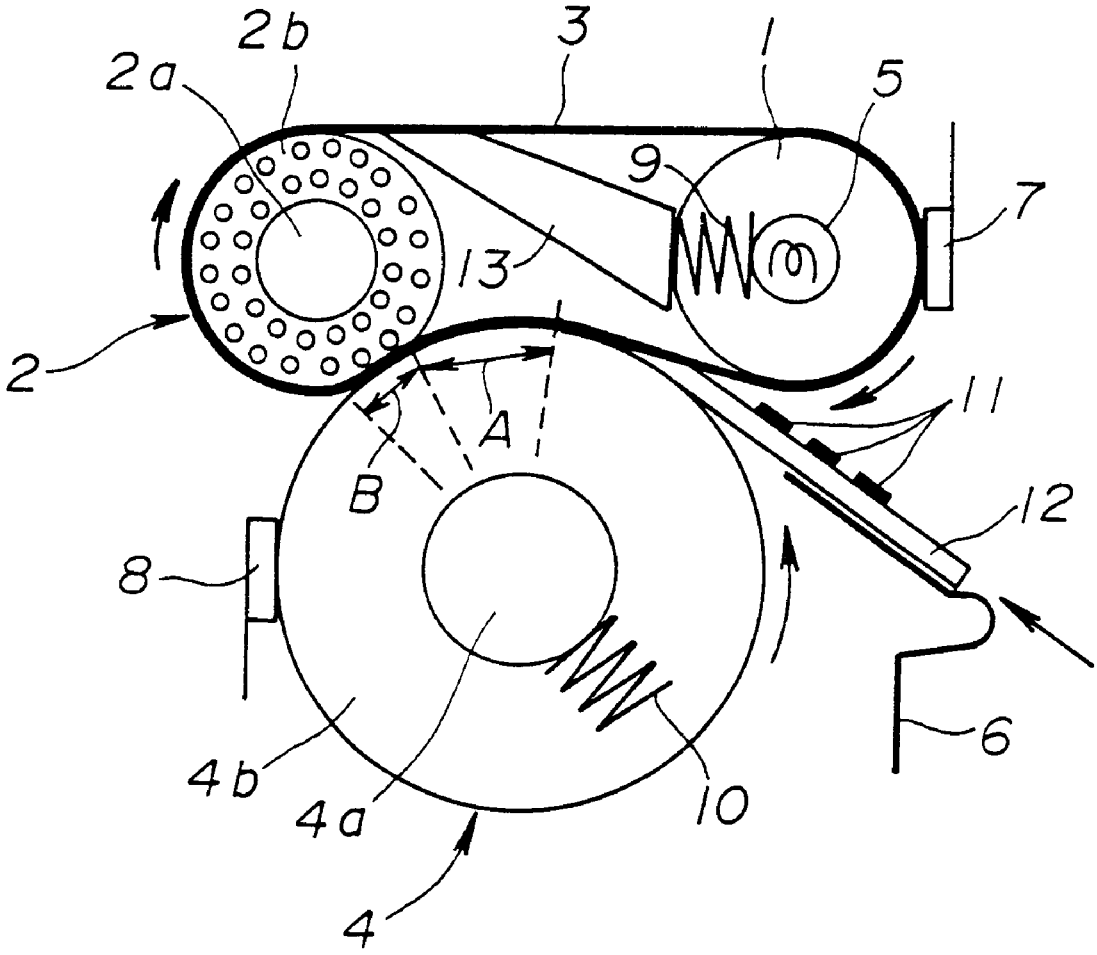
FIG. 8 is an illustration of a part of a fixing apparatus according to a fourth embodiment of the present invention.

A description will now be given of a fourth embodiment of the present invention. FIG. 8 is an illustration of a part of a fixing apparatus according to the first embodiment of the present invention. In FIG. 8, parts that are the same as the parts shown in FIG. 3 are given the same reference numerals.

The fixing apparatus according to the fourth embodiment of the present invention comprises a heat roller 1, a fixing roller 2, a fixing belt 3, a pressing roller 4, a halogen heater 5 for heating the fixing belt 3, a guide plate 6, thermistors 7 and 8, pressing springs 9 and 10 and a heat conductive member 13.

In the fixing apparatus shown in FIG. 8, the fixing belt 3 is drivingly engaged with the heat roller 1 and the fixing roller 2 with a predetermined tension. The pressing roller 4 is pressed against the fixing roller 2 via the fixing belt 3. The heat roller 1, the fixing roller 2, the fixing belt 3 and the pressing roller 4 are rotated by driving mechanism (not shown in the figure) in directions indicated by arrows in FIG. 8. The halogen heater 5 is located inside the heat roller 1 so as to heat the heat roller 1.

The heat roller 1 comprises a thin wall metal pipe having a small diameter so as to reduce a heat mass in order to reduce a warm-up time of the fixing apparatus. As for the metal pipe, an aluminum pipe or a steel pipe may be used. In this embodiment, an aluminum pipe having a diameter of 30 mm and a thickness of 3 mm is used.

The fixing roller 2 comprises a metal core 2*a* having a diameter of 32 mm and a heat-resistive elastic material layer 2*b* provided on the metal core 2*a*. The heat-resistive elastic material layer 2*b* has a thickness of 4 mm. An outer diameter of the fixing roller 2 is 40 mm. The metal core 2*a* is made of aluminum. The heat-resistive elastic material layer 2*b* comprises a silicon sponge rubber, and has a hardness of 30° measured by Asker C.

The fixing belt 3 comprises a nickel electroformed sheet provided with a silicon rubber layer. In this embodiment, the nickel electroformed sheet has a thickness of 40 μm, and the silicon rubber layer has a thickness of 150 μm.

The pressing roller 4 comprises a metal core 4*a* and a heat-resistive elastic material layer 4*b* provided on the metal core 4*a*. In this embodiment, the metal core 4*a* has a diameter of 48 mm, and the heat-resistive elastic material layer 4*b* has a thickness of 1 mm. Thus, an outer diameter of the pressing roller 4 is 50 mm. The metal core is made of aluminum. The heat-resistive elastic material layer 4*b* is made of a silicon solid rubber having a hardness of 42° measured by Asker C.

The halogen heater 5 comprises a halogen lamp provided inside the heat roller 1. The guide plate 6 is located on the upstream side of a portion in which the pressing roller 4 contacts the fixing belt 3 in a conveying direction of a print paper 12. The guide plate 6 is provided for guiding the print paper to the portion between the pressing roller 4 and the fixing belt 3.

The thermistor 7 detects a temperature of a surface of the fixing belt 3 which is heated by the heat roller 1. The thermistor 8 detects a temperature of a surface of the pressing roller 4. In the fixing apparatus according to the present embodiment, the halogen heater 5 is feedback controlled by a control means (not shown in the figurer) based on the temperatures detected by the thermistors 7 and 8 so that the temperature of the surface of the fixing belt 3 and the temperature of the surface of the pressing roller 4 are maintained to be substantially constant.

The pressing spring 9 is provided for pressing the heat roller 1 so as to provide a tension to the fixing belt 3. The pressing spring 10 presses the pressing roller 4 so that the pressing roller 4 is pressed against the fixing roller 2 via the fixing belt 3. It should be noted that a separating claw (not shown in the figure) is provided on the downstream side of a second nip portion B so as to separate the print paper 12, which has passed through the second nip portion B, from the pressing roller 4.

The print paper 12 guided by the guide plate 6 is provided with a toner image 11 formed by a toner of a polyester type. The print paper 12 is a regular paper having a thickness of 100 μm.

The heat conductive member 13, which is made of aluminum, is provided between the heat roller 1 and the fixing belt 3 inside of a loop formed by the fixing belt 3. The heat conductive member 13 has a width of about 270 mm, the width being measured in a direction of a width of the fixing belt 3 (direction perpendicular to the figure). An end of the heat conductive member 13 contacts an inner side of the fixing belt 3 by a distance of about 10 mm along the extending direction of the fixing belt 3. The opposite end of the heat conductive member 13 contacts the heat roller 1 by a distance of amount 10 mm along the outer surface of the heat roller 1. The end of the heat conductive member 13 which contacts the heat roller 1 may be coated with a fluoroplastic material or a fluoroplastic material sheet may be provided between the heat roller 1 and the heat conductive member 13 so as to reduce a frictional force between the heat conductive member 13 and the heat roller 1.

The pressing roller 4 contacts and presses the fixing belt 3 without pressing the fixing roller 2 so that a first nip portion A is formed which corresponds to the first fixing process section. The pressing roller 4 presses the fixing roller 2 via the fixing belt 3 so that the second nip portion B is formed which corresponds to the second fixing process section B. A length of each of the first nip portion A and the second nip portion B is set to about 10 mm. A surface pressure in the second nip portion B is set to about 1.5 $Kg/cm_2$.

In the above-mentioned fixing apparatus, the print paper 12 having a layer of toner 11 (toner image) is conveyed to a fixing section by being guided by the guide plate 6. The toner image 11 is formed on the print paper 12 by an electrophotographic type image forming apparatus. The fixing belt 3 is heated by the heat roller 1 so that a temperature of a surface of the fixing belt 3 contacted by the thermistor 7 is set to about 140° C. A surface of the pressing roller 4 is raised to about 110° C. since the pressing roller 4 rotatably contacts the fixing belt 3. The heat roller 1, the fixing belt 3, the fixing roller 2 and the pressing roller 4 are rotated in directions indicated by arrows, respectively, in the figure.

When the print paper 12 passes the first nip portion A, the toner 11 gradually melts due to a heat from the fixing belt 3 and is tentatively fixed onto the surface of the print paper 12. Since the fixing belt 3 is separated from the heat roller 1 as the fixing belt 3 moves, a temperature of the fixing belt 3 decreases due to a self-cooling action by release of heat. In the second nip portion B, the toner 11 is completely fixed onto the print paper 12, and the print paper 12 is separated from the fixing belt 3 at the exit. At this time, the temperature of the surface of the fixing belt 3 is reduced to less than 120° C. Thus, an increase in the temperature of an interface between the toner 11 and the fixing belt 3 is less than that of the heat roller fixing apparatus, and a hot offset of the toner 11 to the fixing belt 3 is prevented.

In the fixing apparatus according to the present embodiment, the temperature of the fixing belt 3 after passing through the second nip portion B is decreased to about 120° C. due to a self-cooling action of the fixing belt 3 and transmission of heat to the toner 11 and the print paper 12. Particularly, when the print paper 12 is passed through the second nip portion B immediately after the fixing belt 3 starts to rotate so as to achieve a quick start, the temperature of the fixing belt 3 at an exit of the second nip portion B may decrease to even below 120° C.

Although the temperature of the surface of the fixing belt 3, which was decreased in the fixing process, is detected by the thermistor 7, the fixing belt 3 having a decreased temperature enters the first nip portion A to perform a next fixing process since the heater 5 is not turned on at the time the decreased temperature was detected. If the fixing process is performed at a temperature below a setting temperature, a sufficient amount of heat cannot be provided from the fixing belt 3 to the toner 11. In such a condition, the toner 11 may be incompletely melted, and thus there is a problem in that a cold offset of the toner 11 occurs.

However, in the fixing apparatus according to the fourth embodiment, a heat of the heat roller 1 can be transmitted to a portion of the fixing belt 3 which has the decreased temperature through the heat conductive member 13 so that the temperature of the fixing belt 3 is pre-heated at a temperature higher than 120° C. before the fixing belt 3 contacts the heat roller 1. Thus, a recovery of the temperature of the surface of the fixing belt 3 can be speeded up, which prevents an occurrence of an incomplete fixation or a cold offset.

Figure 9:
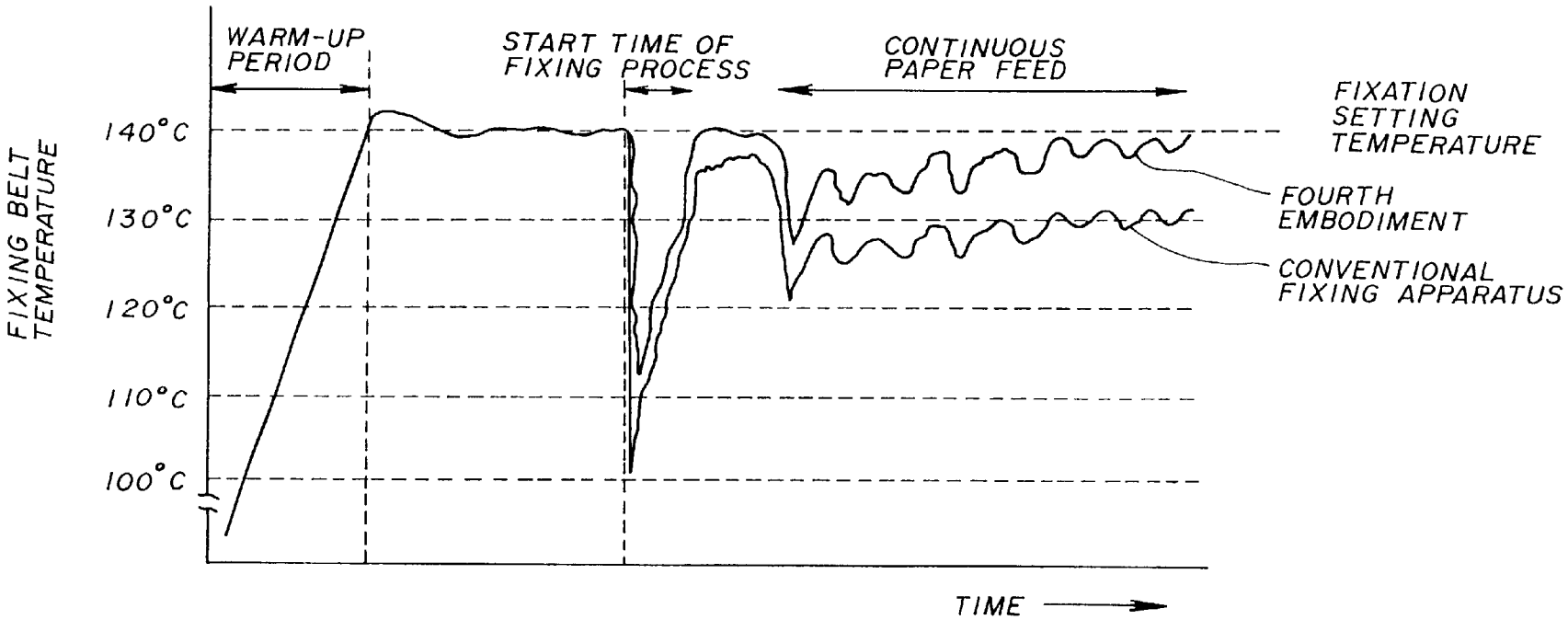
FIG. 9 is a graph showing a result of experiments performed by using the fixing apparatus according to the fourth embodiment of the present invention.

FIG. 9 is a graph showing a result of experiments performed by using the fixing apparatus according to the fourth embodiment of the present invention. It was confirmed from the results of the experiments that the recovery of the temperature of the fixing belt 3 of the fixing apparatus according to the present embodiment is shorter than that of the conventional fixing apparatus. Conditions of the experiments were as follows.

a) setting value of the fixing temperature (fixation setting temperature) . . . 140° C.

b) setting value of surface temperature of the pressing roller 4 . . . 110° C.

c) line velocity of the fixing belt 3 . . . 150 mm/sec.

d) surface pressure of the second nip portion . . . 1.5 kg/cm$^2$ e) print paper 12 . . . regular paper (thickness 0.1 mm)

Figure 10:
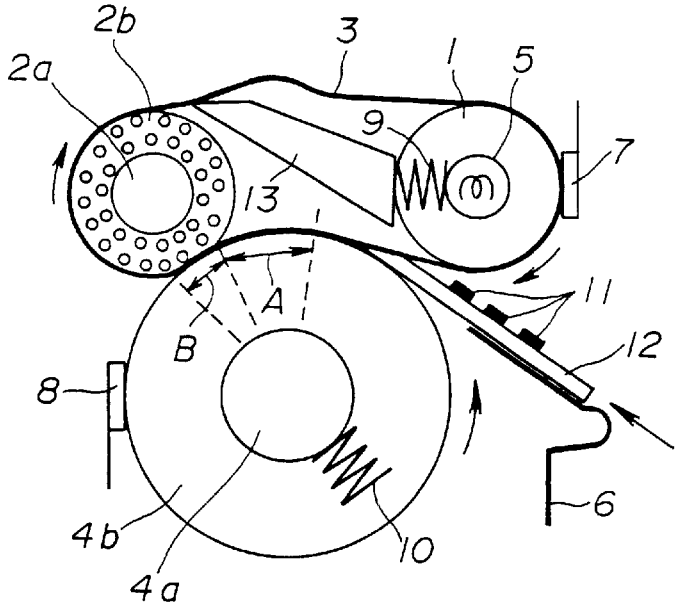
FIG. 10 is an illustration of a part of the fixing apparatus according to the fourth embodiment of the present invention.

In the fixing apparatus according to the above-mentioned fourth embodiment, a slack may be generated in the fixing belt 3 when a tension provided by the pressing spring 9 is varied or the fixing belt 3 is aged with respect to the tension. When a slack is generated in the fixing belt 3, the fixing belt 3 may be separated from the heat conductive member 13 as shown in FIG. 10. This eliminates a heat transmission effect of the heat conductive member 13.

Figure 11:
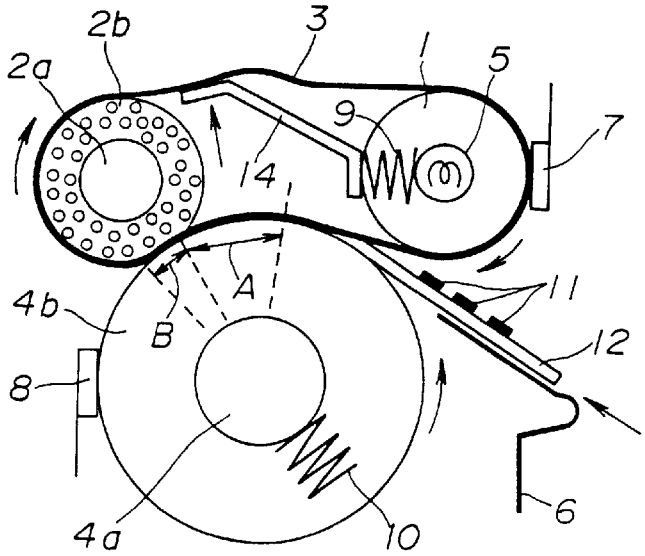
FIG. 11 is an illustration of a part of a fixing apparatus according to a fifth embodiment of the present invention.

A description will now be given, with reference to FIG. 11, of a fifth embodiment of the present invention. FIG. 11 is an illustration of a part of a fixing apparatus according to the fifth embodiment of the present invention. In FIG. 1l, parts that are the same as the parts shown in FIG. 8 are given the same reference numerals, and descriptions thereof will be omitted.

The fixing apparatus according to the fifth embodiment has the same structure as that of the fourth embodiment except for the heat conductive member 13 being replaced with a heat conductive member 14. That is, in the fixing apparatus according to the fifth embodiment of the present invention, the heat conductive member 14 made of a stainless steel spring sheet is used instead of the heat conductive member 13 which is made of aluminum. The heat conductive member 14 is positioned so that the opposite ends elastically contact the fixing belt 3 and the heat roller 1, respectively. Accordingly, when a slack is generated in the fixing belt 3, the end of the heat conductive member 14 maintains a contact with the fixing belt 3 as shown in FIG. 11.

The same effect may be achieved by providing an elastically pressing mechanism to the heat conductive member 13 of the fourth embodiment. However, this may increase a number of parts and manufacturing cost. On the other hand, since the heat conductive member 14 of the fifth embodiment itself has an elasticity, there is no need to provided an additional elastically pressing mechanism.

Figure 12:
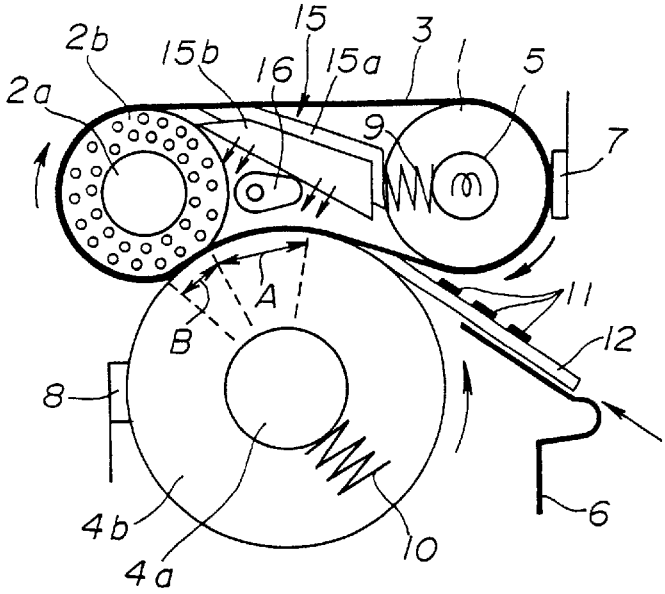
FIG. 12 is an illustration of a part of a fixing apparatus according to a sixth embodiment of the present invention.
Figure 13:
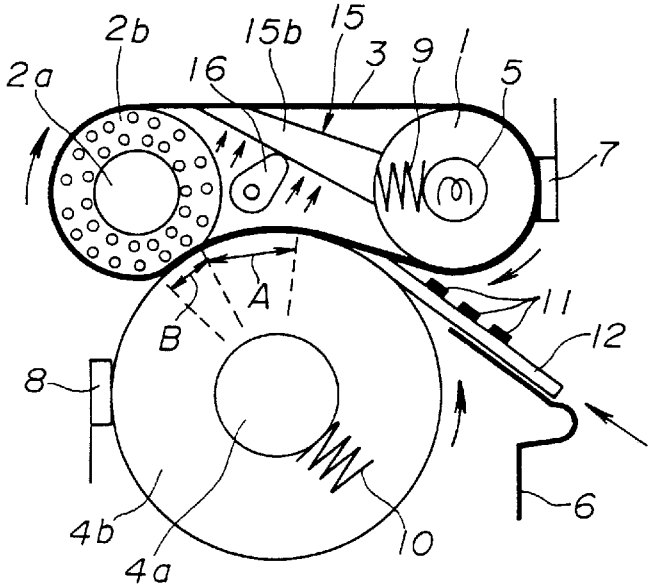
FIG. 13 is an illustration of a part of the fixing apparatus according to the sixth embodiment of the present invention.

A description will now be given, with reference to FIGS. 12, 13 and 14, of a sixth embodiment of the present invention. FIGS. 12 and 13 are illustrations of a part of a fixing apparatus according to the sixth embodiment of the present invention. In FIGS. 12 and 13, parts that are the same as the part shown in FIG. 8 are given the same reference numerals, and descriptions thereof will be omitted.

The fixing apparatus according to the sixth embodiment of the present invention has the same structure as the fixing apparatus according to the fourth embodiment of the present invention except for the heat pressing member 13 being replaced with a heat conductive member 15 and a pressing member 16 being provided to press the heat conductive member 15. Specifically, the heat conductive member 15 is divided into a portion 15*a* and portions 15*b* located on each side of the portion 15*a* . The portion 15*a* and the portions 15*b* can be separately moved by the pressing member 16. The portions 15*a* and portions 15*b* of the heat conductive member are selectively pressed to the fixing belt 3 and the heat roller 1 in accordance with an area of the fixing belt 3 where the print paper 12 contacts the fixing belt 3.

Figure 14:
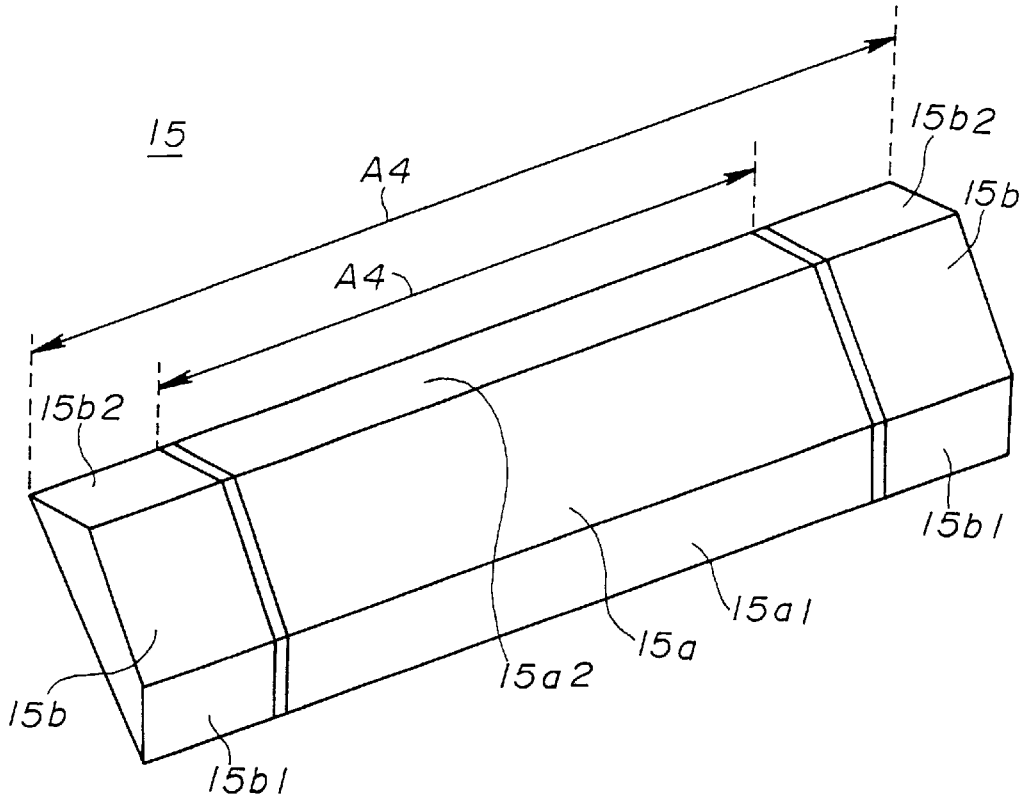
FIG. 14 is a perspective view of a heat conductive member shown in FIGS. 12 and 13.

FIG. 14 is a perspective view of the heat conductive member 15. A length of the portion 15*a* of the heat conductive member 15 corresponds to a width (shorter side: 210 mm) of the A4 standard size paper. A total length of the portion 15*a* and the portions 15*b* corresponds to a length (longer side: 297 mm) of the A4 size paper. The portion 15*a* has end portions 15*a*1 and 15*a*2 which contact the heat roller 1 and the fixing belt 3, respectively. Similarly, each of the portions 15*b* has end portions 15*b*1 and 15*b*2 which contact the heat roller 1 and the fixing belt 3, respectively.

FIG. 12 shows a state in which only the portion 15*a* of the heat providing portion 15 contacts the fixing belt 3 and the heat roller 1. FIG. 13 shows a state in which both the portions 15*a* and the portions 15*b* contact the fixing belt 3 and the heat roller 1. When the print paper 12 is the A4 standard size paper and is conveyed with a shorter side perpendicular to a direction of conveyance, such information is input through an operational panel (not shown in the figure). Then, the portions 15*b* of the heat conductive member 15 are moved by the pressing member 16 as shown in FIG. 12 so that the portions 16*b* are separated from the fixing belt 3 and the heat roller 1. At this time, the portion 15*a* of the heat providing portion 15 is maintained to contact the fixing belt 3 and the heat roller 1. On the other hand, when the print paper 12 is the A4 standard size paper and is conveyed with a longer side perpendicular to a direction of conveyance, such information is input through the operational panel (not shown in the figure). Then, both the portion 15*a* and the portions 15*b* of the heat conductive member 15 are made to contact with the fixing belt 3 and the heat roller 1 as shown in FIG. 13.

If a width of the contact area of the heat conductive member 13 of the fourth embodiment is greater than a width of a contact area of the fixing belt 3 which contact area contacts the print paper 12, a temperature of a non-contact area of the fixing belt 3, which non-contact area does not contact the print paper 12, does not decrease as much as a decrease in a temperature of the contact area. Since the heater 5 is turned on in accordance with a temperature of the contact area of the fixing belt 3 which is detected by the thermistor 7, the temperature of the non-contact area is increased further than the temperature of the contacted area. In this condition, if a heat is further provided to the non-contact area of the fixing belt 3 through the heat conductive member 13, the temperature of the non-contact area may be excessively increased.

In order to eliminate the above-mentioned problem, in the fixing apparatus according to the sixth embodiment, the heat conductive member 15 selectively contacts the contact area of the fixing belt 3. Thus, an excessive increase in the temperature of the non-contact area of the fixing belt 3 can be prevented.

Figure 15:
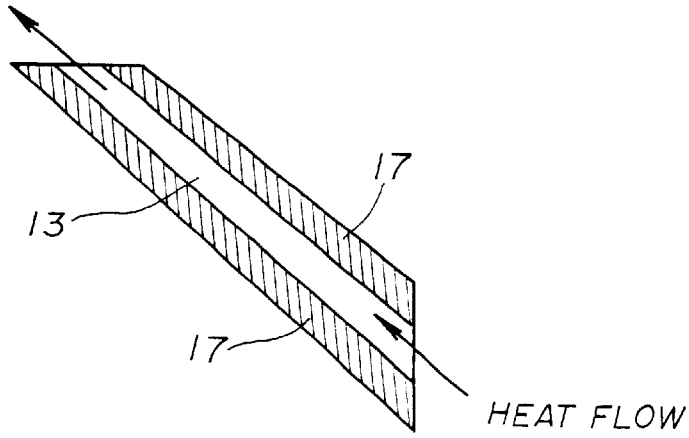
FIG. 15 is a cross-sectional view of a heat conductive member provided in a fixing apparatus according to a seventh embodiment of the present invention.

A description will now be given, with reference to FIG. 15, of a seventh embodiment of the present invention. FIG. 15 is a cross-sectional view of a heat conductive member provided in a fixing apparatus according to the seventh embodiment of the present invention. The fixing apparatus according to the seventh embodiment has the same structure as the structure of the fixing apparatus according to the fourth embodiment except for an insulating material 17 being provided on the heat conductive member 13.

The insulating material 17 is made of a glass wool, and covers surfaces of the heat conductive member 13 other than end surfaces contacting the fixing belt 3 and the heat roller 1. The insulating material 17 reduces a heat released from the heat conductive member 13 to the atmosphere so that a heat in the heat roller 1 is efficiently transmitted to the fixing belt 3. Additionally, since the heat release from the heat conductive member 13 is prevented, an influence of the heat released from the heat conductive member 13 to the first nip portion A is reduced, which results in a stable condition for the fixing process. Thus, a stable fixation of the toner can be achieved.

It should be noted that, although the fixing roller is a drive roller and the heat roller is an idle roller in the belt fixing apparatus according to the above-mentioned embodiments, the heat roller may serve as a drive roller and the fixing roller may serve as an idle roller. Additionally, the pressing roller may serve as a drive roller, or both the fixing roller and the pressing roller may serve as drive rollers.

Additionally, the heat conductive members of the fourth to seventh embodiments of the present invention may be provided to the fixing apparatuses according to the first to third embodiments of the present invention.

The present invention is not limited to the specifically disclosed embodiments, and variations and modifications may be made without departing from the scope of the present invention.

What is claimed is:

1. A fixing apparatus for fixing a toner provided on a recording sheet, said fixing apparatus comprising:

a fixing roller including a foamed silicone rubber layer;

a heat roller configured to generate heat;

an endless fixing belt drivingly engaged with said fixing roller and said heat roller;

a pressing roller pressed against said fixing roller via said fixing belt such that a fixing process area is formed between said fixing roller and said pressing roller, wherein the toner provided on the recording sheet contacts the fixing belt, the recording sheet is passed through said fixing process area in order that the toner provided on the recording sheet receives a uniform heat from said fixing belt, and said pressing roller pressingly contacts said fixing belt before said fixing process area is formed such that a pre-heating area is formed as a contact area of said pressing roller and said fixing belt; and wherein said pressing roller is harder than said fixing roller, said foamed silicone rubber layer is elastically deformable by said pressing roller, the hardness of said fixing roller is 10° to 50° measured by Asker C, and the hardness of said pressing roller is higher than the hardness of the fixing roller by 0° to 30° measured by Asker C in order to apply a substantially uniform and low pressure on said fixing process area.

2. The fixing apparatus according to claim 1, wherein said foamed material layer of the pressing roller is made of a foamed silicon rubber.

3. The fixing apparatus according to claim 1, wherein said pressing roller includes a foamed material layer.

4. The fixing apparatus according to claim 3, wherein said foamed material layer of the pressing roller is made of a foamed silicon rubber.

5. The fixing apparatus as claimed in claim 1, wherein said endless fixing belt comprises:

a base layer formed of a metal; and a second layer having a toner-release characteristic.

6. The fixing apparatus as claimed in claim 1, wherein said pressing roller is harder than said foamed silicone rubber layer of said fixing roller and said foamed silicone rubber layer is elastically deformable by said pressing roller in order to apply a substantially uniform pressure on the fixing process area such that waves generated on the recording sheet due to a difference in pressure between the pre-heating area and the fixing process area are not transformed into wrinkles in the fixing process area.

7. The fixing apparatus as claimed in claim 1, wherein said foamed silicone rubber layer directly pressingly contacts said fixing belt.

8. A fixing apparatus for fixing a toner provided on a recording sheet, said fixing apparatus comprising:

a fixing roller;

a heat roller configured to generate heat;

an endless fixing belt drivingly engaged with said fixing roller and said heat roller; and a pressing roller pressed against said fixing roller via said fixing belt so that a fixing process area is formed between said fixing roller and said pressing roller, the recording sheet being passed through said fixing process area so that the toner provided on the recording sheet receives a heat from said fixing belt;

wherein said fixing roller includes a formed material layer elastically deformable by said pressing roller, and also including a heat conductive member having a first end surface and a second end surface remote from said first end surface, said first end surface contacting said heat roller, said second end surface contacting said fixing belt.

9. The fixing apparatus as claimed in claim 8, wherein said heat conductive member is positioned inside of a loop formed by said fixing belt, and said second end surface of said heat conductive member contacts an inner surface of said fixing belt.

10. A fixing apparatus for fixing a toner provided on a recording sheet, said fixing apparatus comprising:

a fixing roller;

a heat roller generating heat;

an endless fixing belt drivingly engaged with said fixing roller and said heat roller;

a pressing roller pressed against said fixing roller via said fixing belt so that a fixing process area is formed between said fixing roller and said pressing roller, the recording sheet being passed through said fixing process area so that the toner provided on the recording sheet receives a heat from said fixing belt; and a heat conductive member having a first end surface and a second end surface remote from said first end surface, said first end surface contacting said heat roller, said second end surface contacting said fixing belt.

11. The fixing apparatus as claimed in claim 10, wherein said heat conductive member is positioned inside of a loop formed by said fixing belt, and said second end surface of said heat conductive member contacts an inner surface of said fixing belt.

12. The fixing apparatus as claimed in claim 11, wherein said heat conductive member is made of an elastically deformable material.

13. The fixing apparatus as claimed in claim 11, wherein a width of a contact area of said heat conductive member to said fixing belt is variable in response to a width of the recording sheet, the width being measured in a direction perpendicular to a moving direction of said fixing belt.

14. The fixing apparatus as claimed in claim 10, further comprising a heat insulating material covering surfaces of said heat conductive material other than said first end surface and said second end surface.

* * * * *